United States Patent [19]

Klug

[11] 4,010,989

[45] Mar. 8, 1977

[54] LOCKABLE DRAWER COMPARTMENT

[75] Inventor: Joseph R. Klug, Manitowoc, Wis.

[73] Assignee: American Hospital Supply Corporation, Evanston, Ill.

[22] Filed: Oct. 14, 1975

[21] Appl. No.: 622,146

[52] U.S. Cl. ..... 312/204; 70/85; 312/215; 312/333

[51] Int. Cl.[2] ..... A47B 88/00

[58] Field of Search ..... 70/85, 86; 312/204, 312/209, 215, 231, 320, 333; 108/1

[56] References Cited

UNITED STATES PATENTS

| | | | |
|---|---|---|---|
| 1,330,936 | 2/1920 | Erickson | 70/85 |
| 1,496,099 | 6/1924 | O'Connor | 70/86 |
| 2,696,415 | 12/1954 | Himelson | 312/231 |
| 3,166,364 | 1/1965 | Shorin, Jr. | 70/85 |
| 3,649,095 | 3/1972 | Gunzburg | 70/85 |

*Primary Examiner*—Casmir A. Nunberg

[57] ABSTRACT

A drawer is provided with a covered compartment and a lock which can lock both the drawer and the cover of the compartment, or lock the cover and unlock the drawer to permit the drawer to be opened without permitting access to the compartment, or unlock both the drawer and the cover to permit access to the compartment.

6 Claims, 9 Drawing Figures

47
48
46
50
9
9'
52
54
55
56
51
45
49
23
19
22
23
18
17
51'
53
51
52
54
55
52
57
56
58

LOCKABLE DRAWER COMPARTMENT

BACKGROUND AND SUMMARY

This invention relates to a lockable, covered compartment for a drawer and, more particularly, to a covered compartment and locking means therefor which can lock both the drawer and the compartment, or lock the compartment but unlock the drawer, or unlock both the drawer and the compartment.

The invention finds particular utility in a reference drawer for a drafting table and will be explained in conjunction therewith. It will be understood, however, that the invention can be used in other types of drawers. A reference drawer generally provides a large rectangular compartment for storing mechanical drawings and the like in a flat, unfolded and unrolled condition. The drawer may be provided with a lock which can lock the drawer for desired security after working hours. However, since access to the drawings may be needed by several people, either the drawer is left unlocked during the day or several people have keys for the lock. As a result, the draftsman using the drafting table does not have any private storage space within the drawer for his drafting instruments and other personal items.

In accordance with the invention, a reference drawer is provided with a small compartment and a cover for the compartment which can be moved to open and close the compartment. A lock on the door is movable between three positions. In one position of the lock both the reference drawer and the compartment cover are locked in a closed position. In another position of the lock the reference drawer is unlocked and can be opened, but the cover is maintained locked so that access to the compartment is prevented. In the third position the cover is also unlocked so that the cover can be opened.

DESCRIPTION OF THE DRAWING

The invention will be explained in conjunction with an illustrative embodiment shown in the accompanying drawing, in which.

DESCRIPTION OF SPECIFIC EMBODIMENT

Figure 1:
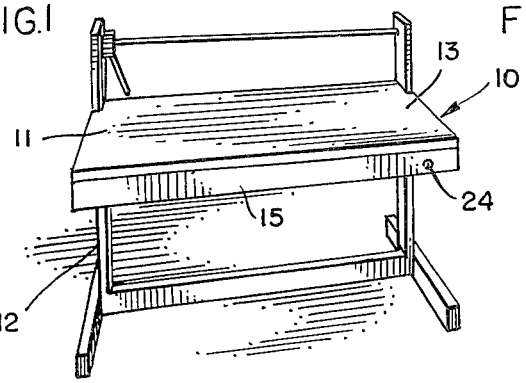
FIG. 1 is a front perspective view of a drafting table and a reference drawer equipped with a lockable drawer compartment in accordance with the invention.
Figure 2:
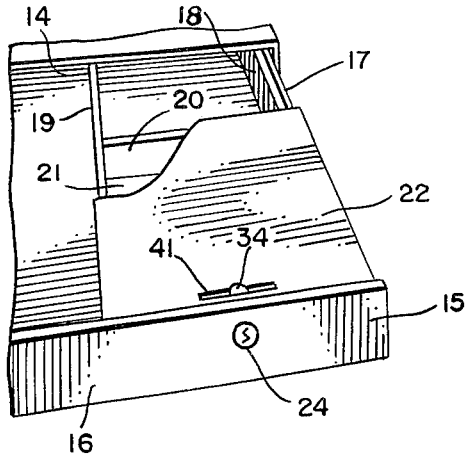
FIG. 2 is a fragmentary front perspective view of the reference drawer in an opened position and the compartment cover in a closed position.
Figure 3:
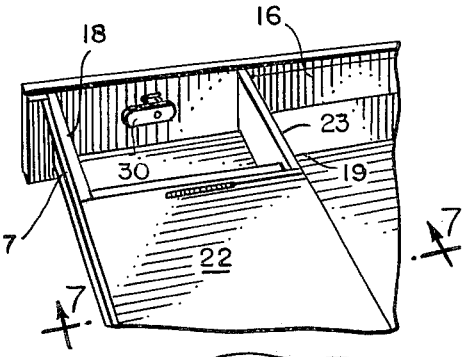
FIG. 3 is a rear fragmentary perspective view of the reference drawer in an opened position with the compartment cover in a partially opened position.

Referring first to FIGS. 1–3, the numeral 10 designates generally a conventional drafting table which includes a cabinet or frame portion 11 and support legs 12. The frame includes a flat top surface 13 for supporting drawings and is provided with a generally rectangular front opening 14 below the top surface which slidably receives a reference drawer 15.

The reference drawer may be conventional and includes a front wall 16, a pair of side walls 17 (only one of which is shown), and a rear wall (not shown). The drawer is movable between a closed position (FIG. 1) in which the front wall thereof is substantially flush with the front of the frame 11 and an open position (FIG. 2) in which drawings and the like stored within the drawer can be removed.

A compartment wall 18 extends between the front and rear walls of the drawer adjacent to and parallel with the right side wall 17, another compartment wall 19 is spaced laterally inwardly from the wall 18 and extends parallel thereto, and a rear compartment wall 20 extends between the walls 18 and 19 parallel to the front wall 16 to form a compartment 21. The width of the compartment is small compared to the width of the entire drawer so that most of the drawer space can be used to store drawings. A cover 22 is slidably mounted on the compartment walls 18 and 19 and has a length of about one-half the length of the drawer. Each of the walls 18 and 19 includes an outwardly flanged upper edge or rail 23 (FIG. 7), and the side edges of the cover extend inwardly below the flanged edges so that the cover is secured to the walls against upward movement but can slide freely on the walls.

When the cover is in the closed position of FIG. 2, the compartment 21 is covered. When the cover is slid rearwardly as in FIG. 3, access to the compartment is permitted.

Figure 5:
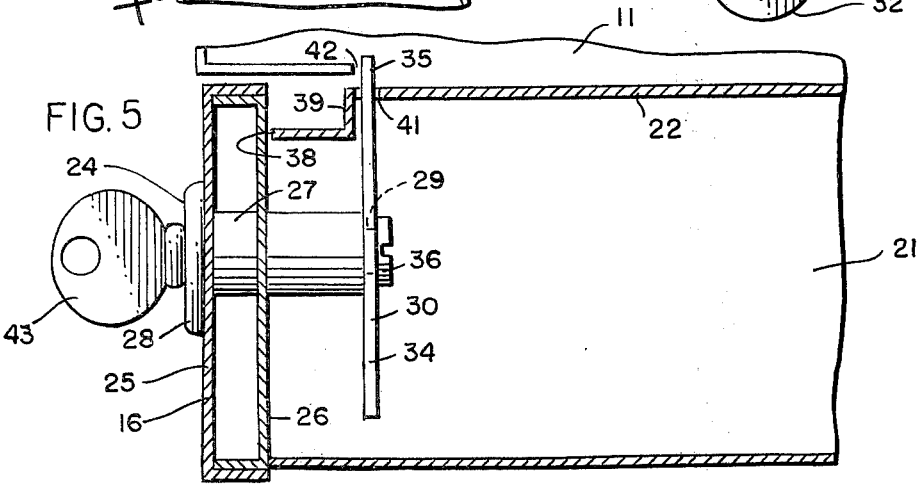
FIG. 5 is a fragmentary sectional view showing the lock in the position in which both the drawer and the compartment cover are locked.
Figure 6:
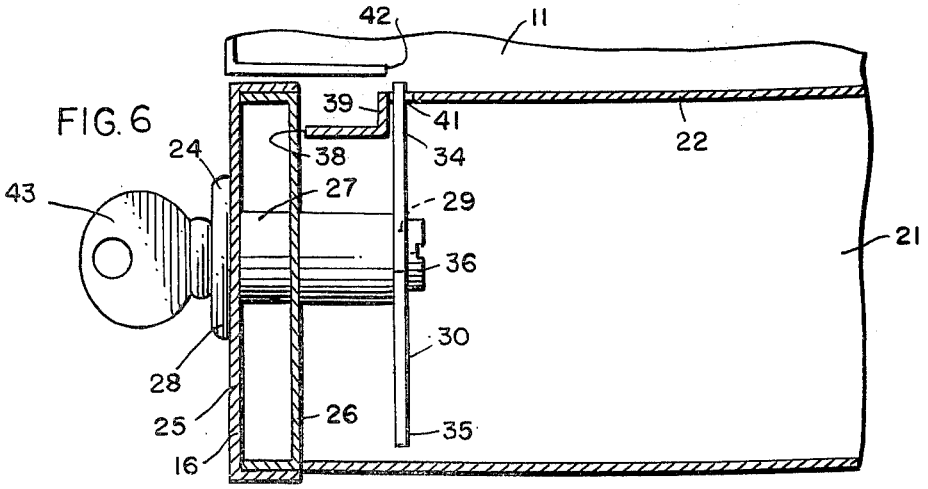
FIG. 6 is a view similar to FIG. 5 showing the lock in the position in which the drawer is unlocked and the compartment cover is locked.

A lock 24 is mounted on the front wall 16 of the drawer for locking the drawer and the cover. As can be seen in FIGS. 5 and 6, the front wall is formed from a pair of channel-shaped panels or heads 25 and 26 which are secured together, and the lock cylinder 27 of the lock is securely mounted in openings in the panels. A mounting collar 28 abuts the front surface of the panel 25, and a rotatable shaft 29 extends rearwardly from the lock cylinder into the compartment.

Figure 4:
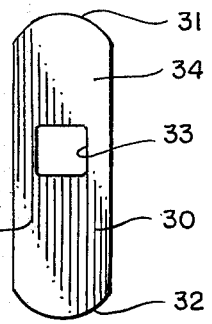
FIG. 4 is an elevational view of the locking latch.

A locking latch 30 (see also FIG. 4) is formed from a flat strip of metal and is provided with rounded ends 31 and 32 and a square opening 33. The opening is positioned closer to the end 31 than the end 32 to provide a short latching portion 34 and a long latching portion 35. The lock shaft 29 has a cross section corresponding to the shape of the opening 33, and the latch is non-rotatably mounted on the shaft and retained thereon by a screw 36.

The front edge 38 of the compartment cover 22 is offset downwardly from the remainder of the cover by a shoulder portion 39, and the front edge butts against inside drawer head 26 when the cover is closed. A locking slot 41 is formed in the cover just rearwardly of the shoulder 39, and the slot is vertically aligned with the locking latch when the cover is closed. A locking recess or shoulder 42 is formed in the frame 11 which provides the drawer opening, and the shoulder 42 is also vertically aligned with the locking latch.

The lock shaft is operated by a key 43. When the cover is closed and the shaft is rotated by the key so that the long latching portion 35 extends upwardly as in FIG. 5, the latching portion 35 will extend through the locking slot 41 and past the shoulder 42. The drawer is thereby locked and cannot be withdrawn from the frame. When the shaft is rotated so that the short latching portion 34 extends upwardly as in FIG. 5, the short latching portion extends through the slot 41 but terminates below the shoulder 42. The drawer is then unlocked and can be pulled out of the drawer opening as shown in FIG. 2. However, the cover is locked in the closed position, and the compartment will remain closed when the drawer is opened. Alternatively, the short latching portion 35 can terminate below the slot 41 but in a position to engage the shoulder 39 to prevent opening of the cover.

When access to the compartment is desired, the key is used to rotate the latch into a generally horizontal position as shown in FIG. 3. Both the drawer and the cover can then be freely opened and closed.

A draftsman can store his drafting instruments and other personal items in the compartment and lock both the drawer and the compartment at the end of each day. In the morning, the draftsman can unlock the drawer so that others can have access to the drawings contained therein but can keep the compartment cover locked so that his instruments are safe.

It will be appreciated from the foregoing that it is unnecessary to move the cover into the closed position in order to lock the drawer within the frame. If the front end of the cover is positioned rearwardly of the locking latch, the long latching portion 35 can be rotated against the shoulder 42 to lock the drawer without passing through the slot 41 in the cover.

Many variations of the lockable compartment are possible. For example, although the cover 22 of the compartment is slidably mounted on separate compartment walls 18 and 19, one side of the cover could be mounted directly on the side wall 17 of the drawer. Alternatively, the cover could extend for the entire width of the drawer and be mounted on both side walls of the drawer. In this case, the fore and aft length of the cover should be relatively short compared to the fore and aft length of the drawer. The cover may also be hingedly mounted on the drawer.

Figures 7, 8, 9:
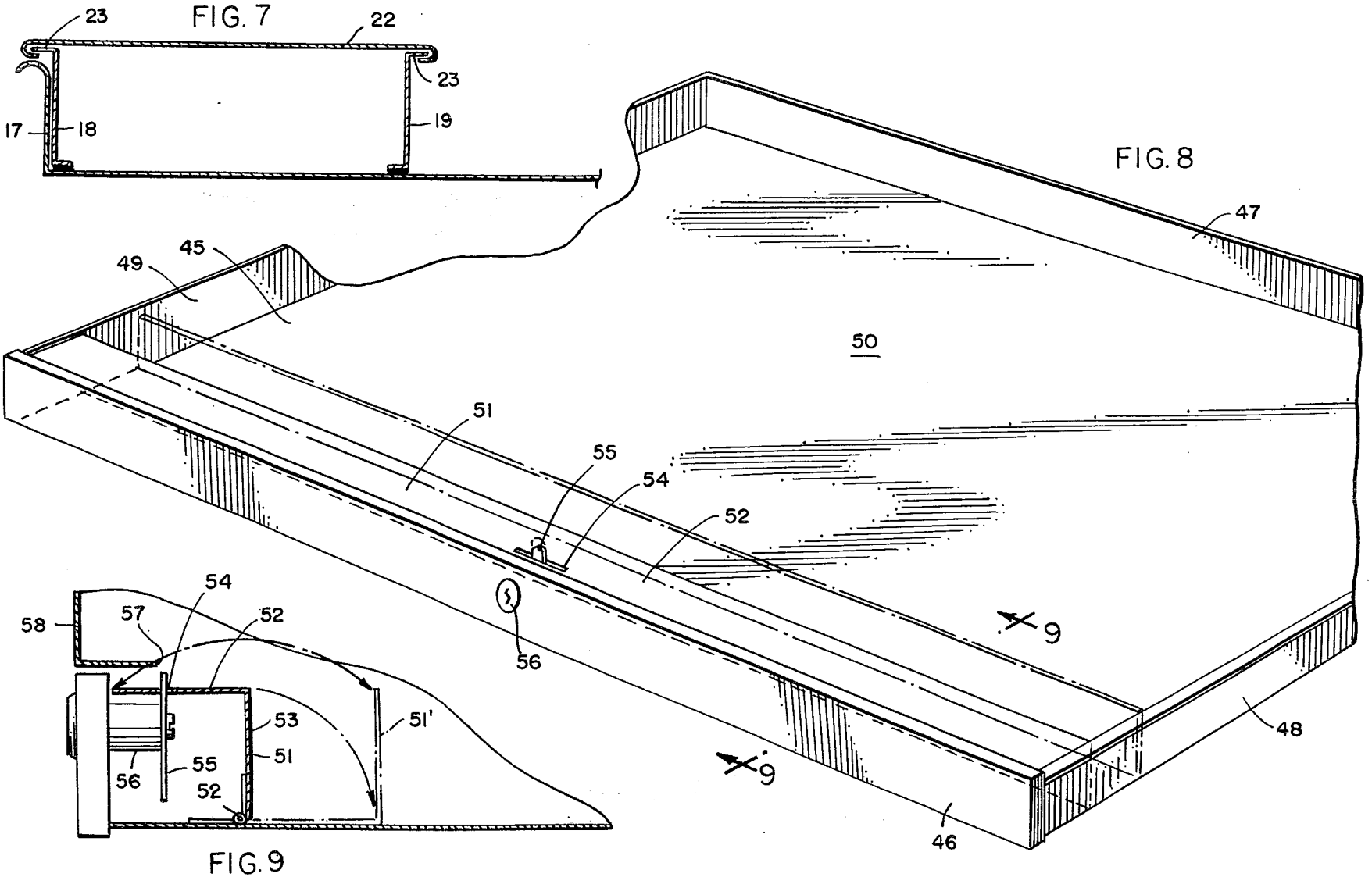
FIG. 7 is a fragmentary sectional view taken along the line 7—7 of FIG. 3.
FIG. 8 is a perspective view of a reference drawer equipped with another embodiment of a lockable compartment.
FIG. 9 is a fragmentary sectional view as would be seen along the line 9—9 of FIG. 8 of the drawer and table.

Another embodiment of a lockable drawer compartment is illustrated in FIGS. 8 and 9. A reference drawer 45 includes front, rear, and side walls 46, 47, 48, and 49 and a bottom wall 50. An L-shaped compartment wall 51 is hingedly mounted to the bottom wall 50 by a piano hinge 52 and is swingable between an upright position illustrated in solid in FIGS. 8 and 9 and an open position illustrated in phantom at 51'.

The compartment wall 51 includes a cover portion 52 which extends horizontally when the compartment wall is in the upright or closed position and a base portion 53 which extends vertically when the compartment wall is in the closed position. The cover portion 52 is provided with a locking slot 54 aligned with the locking latch 55 of the lock 56.

The locking latch 55 is identical to the locking latch 30 and has a short latching portion and a long latching portion. The short latching portion extends upwardly in FIG. 9 and extends through the locking slot 54 in the cover but terminates below the locking shoulder 57 provided by the table frame 58. In this position, the compartment wall is prevented from swinging to its open position, but the reference drawer can be pulled out of the drawer opening. When the long latching portion extends upwardly through the slot 54, it will extend upwardly beyond the shoulder 57 and lock the drawer.

When it is desired to open the compartment, the lock is turned to move the locking latch into a horizontal position, and the compartment wall can be swung to the open position illustrated in phantom.

The compartment wall 51 illustrated extends for the full width of the drawer, and the ends of the compartment are closed by the side walls of the drawer. However, it will be understood that the side-to-side dimension of the compartment can be reduced, and the compartment wall can be provided with side walls to close the ends of the compartment.

While in the foregoing specification detailed descriptions of specific embodiments of the invention were set forth for the purpose of illustration, it is to be understood that many of the details hereingiven may be varied considerably by those skilled in the art without departing from the spirit and scope of the invention.

I claim:

1. A drawer for use with a supporting frame in which the drawer is movable between open and closed positions and is provided with a compartment therewithin, a cover for the compartment movably mounted on the drawer, the cover being movable between a closed position in which access to the compartment is prevented and an open position in which the compartment is substantially uncovered, and locking means on the drawer movable between a first position in which both the drawer and the cover of the drawer compartment are locked in their closed positions, a second position in which the drawer is unlocked and the cover is locked, and a third position in which both the drawer and the cover are unlocked and are freely movable between their open and closed positions.

2. The structure of claim 1 in which the locking means includes an elongated generally vertically extending latch which is mounted for rotation about a generally horizontally extending axis to provide first and second latch portions extending away from the axis, the first latch portion being longer than the second latch portion, the cover of the drawer compartment being provided with an opening therethrough, the latch being rotatable between a first position in which the first latch portion extends through the opening in the cover and into locking engagement with the frame whereby both the drawer and the cover of the drawer compartment are locked in their closed positions, a second position in which the second latch portion extends into locking engagement with the cover but terminates short of the frame whereby the cover is locked in its closed position but the drawer is freely movable between its open and closed positions, and a third position in which neither latch portion extends through the opening in the cover or into locking engagement with the cover whereby both the drawer and the cover are freely movable between their open and closed positions.

3. The structure of claim 1 in which the drawer includes a front wall on which the locking means is mounted, a pair of side compartment-forming walls which extend rearwardly from the front wall, the cover being slidably mounted on the side walls and positioned adjacent the front wall when it is in the closed position and being slidable rearwardly to the open position.

4. A drawer for use with a supporting frame in which the drawer includes a front wall and is movable between open and closed positions, a cover hingedly mounted on the drawer and swingable between a closed position in which the cover is adjacent the front wall and forms a covered compartment within the drawer and an open position in which the cover is spaced from the front wall, and locking means on the front wall for locking the cover in the closed position.

5. The structure of claim 4 in which the cover includes a base portion which is hingedly secured to the drawer and which extends generally parallel to the front wall when the cover is in the closed position and a cover portion which extends generally perpendicularly to the front wall when the cover is in the closed position.

6. The structure of claim 4 in which the locking means includes an elongated generally vertically extending latch which is mounted for rotation about a generally horizontally extending axis to provide first and second latch portions extending away from the axis, the first latch portion being longer than the second latch portion, the cover of the drawer compartment being provided with an opening therethrough, the latch being rotatable between a first position in which the first latch portion extends through the opening in the cover and into locking engagement with the frame whereby both the drawer and the cover of the drawer compartment are locked in their closed positions, a second position in which the second latch portion extends into locking engagement with the cover but terminates short of the frame whereby the cover is locked in its closed position but the drawer is freely movable between its open and closed positions, and a third position in which neither latch portion extends through the opening in the cover or into locking engagement with the cover whereby both the drawer and the cover are freely movable between their open and closed positions.

* * * * *